US006740722B2

(12) United States Patent
Capone et al.

(10) Patent No.: US 6,740,722 B2
(45) Date of Patent: May 25, 2004

(54) LOW DENSITY ACRYLIC FIBER

(75) Inventors: Gary J. Capone, Decatur, AL (US); Danny W. Carter, Athens, AL (US); C. Wayne Emerson, Harselle, AL (US)

(73) Assignee: Solutia Inc., St. Louis, MO (US)

( * ) Notice: Subject to any disclaimer, the term of this patent is extended or adjusted under 35 U.S.C. 154(b) by 0 days.

(21) Appl. No.: 09/963,110

(22) Filed: Sep. 25, 2001

(65) Prior Publication Data

US 2003/0057593 A1 Mar. 27, 2003

(51) Int. Cl.[7] ..... C08F 118/02

(52) U.S. Cl. ..... 526/319; 428/359; 428/364; 428/375; 428/394; 264/182; 264/210.8

(58) Field of Search ..... 526/319; 264/182, 264/210.8; 428/364, 359, 375, 394

(56) References Cited

U.S. PATENT DOCUMENTS 3,624,195 A * 11/1971 Nakayama et al. ..... 264/168
3,926,513 A * 12/1975 Silver et al. ..... 242/334
3,926,930 A * 12/1975 Ohfuka et al. ..... 525/326.8
3,929,946 A * 12/1975 Orito et al. ..... 264/182
4,324,095 A * 4/1982 Lulay et al. ..... 428/359
4,347,203 A * 8/1982 Mimura et al. ..... 264/172.14
5,458,968 A * 10/1995 Bittle et al. ..... 428/357
5,496,510 A * 3/1996 Capone ..... 264/178 F
6,066,687 A * 5/2000 Capone et al. ..... 524/431
6,114,034 A * 9/2000 Jorkasky et al. ..... 428/359

* cited by examiner

*Primary Examiner*—Tatyana Zalukaeva
(74) *Attorney, Agent, or Firm*—Howrey Simon Arnold & White, LLP; John P. Foryt

(57) ABSTRACT

An acrylic fiber having cotton-like properties with modified, internal void structure and optical characteristics, the acrylic fiber comprising a BYK Gardner Luster (BYL) reflectance measurement of less than about 44.

19 Claims, 1 Drawing Sheet

Phase Contrast Microscopy Magnification 338X

Phase Contrast Microscopy Magnification 338X

LOW DENSITY ACRYLIC FIBER

FIELD OF THE INVENTION

The present invention relates to an acrylic fiber having cotton-like properties. Moreover, the present invention relates to a process for fabricating such an acrylic fiber.

BACKGROUND

Acrylic fibers developed hitherto have been advantageously utilized in the textile industry as stock materials for winter clothes, due to the excellent physical and chemical properties and wool-like feeling of the fibers. Numerous textile applications (e.g., under garments, bed linens, summer clothing, etc.) require the use of cotton and/or cotton-like fibers, which are soft to the touch and have excellent moisture absorption and diffusion properties. The very wool-like properties of acrylic fiber, (i.e., high density, low porosity, course touch, etc.) that provide for their use in winter clothes also prohibit their use in other textiles applications that require cotton-like qualities. Accordingly, numerous efforts have been implemented to render acrylic fibers suitable for use in textile applications where cotton fibers have been exclusively utilized.

For example, in U.S. Pat. No. 4,810,449 and British Patent No. 1,532,770, the entire subject matter thereof being incorporated herein by reference, a "bicomponent" acrylic fiber is disclosed having a core-jacket structure, the microporous core being capable of absorbing water while the jacket is not. However, this fiber maintains wool-like characteristics with no cotton-like feel.

U.S. Pat. Nos. 3,929,946 and 4,347,203, the entire subject matter thereof being incorporated herein by reference, relate to the production of acrylic fibers having internal voids therein. However, when forming multiple voids in acrylic fiber it is difficult to control the size and number of voids and, thus, the fiber is at the most not consistently reproducible, and at the very least yields a fiber that is unacceptably fibrillated. Additionally, such acrylic fiber remains unacceptably wool-like to the touch.

U.S. Pat. No. 4,455,347, the entire subject matter of which is incorporated herein by reference, refers to the preparation of an acrylic fiber having an uneven surface. Even though such acrylic fiber does not feel as wool-like as other acrylic fibers, it does not attain true cotton-like hand properties and such fiber does not adequately absorb moisture.

U.S. Pat. No. 4,812,361, the entire subject matter of which is incorporated herein by reference, relates to the construction of an acrylic fiber possessing a Y-type cross-section. This fiber has improved softness to the touch, but also does not attain true cotton-like hand properties and does not possess satisfactory moisture absorbing and diffusion properties.

Despite the number and variety of methods implemented to modify acrylic fibers, it has not yet been possible to readily produce acrylic fibers having properties that even remotely approach the desirable properties of cotton. Accordingly, there is a need in the textile industry for an acrylic fiber possessing not only a cotton-like feel, but also with cotton-like moisture absorbing and diffusing properties.

SUMMARY OF THE INVENTION

The present invention relates to an acrylic fiber, and method of production thereof, that possesses excellent moisture absorbing and diffusing properties, and moreover, a cotton-like feel.

In one embodiment, the present invention comprises a cotton-like acrylic fiber having a BYK Gardner Lustermeter (BGL) reflectance measurement of less than about 44.

In another embodiment, acrylic fiber of the present invention comprises an acrylic fiber having one or more internal voids and a denier of less than 1.5 dpf, including microdeniers less than 1.0 dpf. In a further embodiment, acrylic fiber of the present invention comprises less than two internal voids within a cross-section of the fiber and extending parallel to the fiber.

DETAILED DESCRIPTION OF PREFERRED EMBODIMENTS

Figure 1:
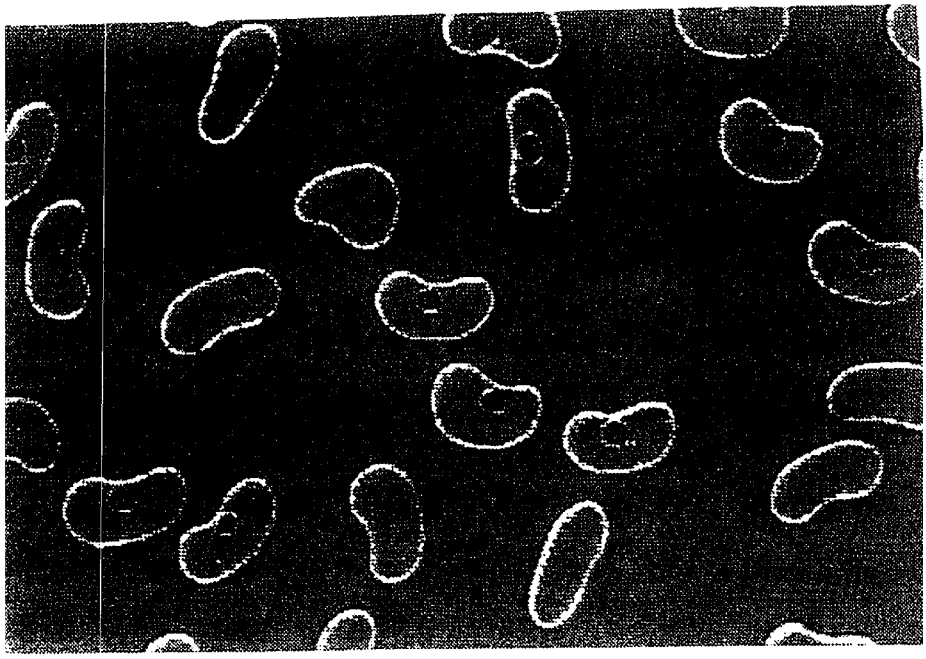
FIG. 1 is an enlarged microscopic photograph (phase contrast microscopy; magnification: 338 times) of the cross-section of a fiber of the present invention in which the fiber possesses one internal void.

In accordance with the present invention, an acrylic fiber is produced that possesses cotton-like properties that enable such fiber to be utilized in a variety of textile applications that heretofore have been exclusively dominated by cotton and other non-synthetic fibers. The cotton-like acrylic fiber of the present invention is low in density, high in porosity and is soft to the touch.

An acrylic fiber of the present invention possess cotton-like properties that are demonstrated by certain optical properties without the use of luster additives or modifiers such as $TiO_2$. Certain fiber luster properties impact acrylic fiber with cotton-like qualities (i.e., low in density, porosity, absorbency, soft to the touch, etc.). In the textile industry, optical properties of the fiber (i.e., gloss, reflectance and luster), as measured by BYK Gardener Lustermeter (BGL) available from BYK-Gardener GmbH, is an accepted technique by which fiber properties are measured. Luster, or Contrast Gloss, is defined as the "gloss associated with contrasts of bright and less bright adjacent areas of the surface of an object." See Hunter, R. S., "The Measurement of Appearance", John Wiley & Sons, N.Y. (1975). Specifically, it is the contrast and ratio between the specular reflectance and the diffuse reflectance. See Judd, D. B., and Wyszecki, G., "Color in Business, Science and Industry", John Wiley & Sons, N.Y. (1975). The specular reflectance factor can be expressed as $R_S$ (45°/45° gloss), and the diffuse reflectance factor expressed as $R_D$ (45°/0° diffuse reflectance). Reflectance indicates thw degree of diffuse light at 90 degrees to the fiber surface with the incident light at 45 degrees to the other fiber surface. The angle between the light source and detector is 45 degrees. Gloss designates the degree of light measured at 45 degrees to the fiber surface with the incident light again at 45 degrees to the fiber surface. The angle between the light source and detector is 90 degrees. Luster is calculated from the ratio of Gloss to Reflectance as follows:

$$\text{Luster}=100-(4.5)\times(R_d/R_s)$$

BGL measurements are made on metal cards, in which sliver/yam samples have been either hand-wound or machine-wound onto the card. The card is measured 4 times with the BGL, rotating the card 180° after each reading. The average $R_S$, $R_D$ and Luster are obtained and recorded.

One embodiment of the present invention, an acrylic cotton-like fiber possesses a BYK Gardner Lustermeter reflectance (BGL $R_D$) of less than about 44, preferably less than about 40, and more preferably less than about 35. In another embodiment, an acrylic fiber of the present invention possesses a BYK Gardner Lustermeter gloss (BGL $R_S$) of greater than about 17, preferably greater than about 20, and more preferably greater than about 24. In a further embodiment, an acrylic fiber of the present invention possesses a BYK Gardner Lustermeter luster value (BGL Luster) of greater than about 88, preferably greater than about 90, and more preferably greater than about 92. In yet another embodiment, an acrylic fiber of the present invention possesses a BYK Gardner Lustermeter reflectance (BGL $R_D$) of less than about 44, a BGL $R_S$ gloss of greater than about 17, and a BGL luster of greater than about 88. Preferably, the fiber possesses a BGL $R_D$ reflectance of less than about 40, a BGL $R_S$ gloss of greater than about 20, and a BGL Luster of greater than about 90. More preferably, the fiber possesses a BGL $R_D$ reflectance of less than about 35, a BGL $R_S$ gloss of greater than about 24, and a BGL Luster of greater than about 92.

In another embodiment of the present invention, a cotton-like acrylic fiber is produced that has one or more internal void(s) within a cross-section of the fiber as shown in FIG. 1. The fiber possesses a denier of less than 1.5 dpf, preferably less than 1.2 dpf, and more preferably a microdenier of less than 1.0 dpf. In contrast to previous efforts to produce cotton-like acrylic fiber, the topology is not the single means by which cotton-like properties are imparted to the fiber. The surface roughness of acrylic fiber of the present invention may be less than 0.05 (l/d) (in which 1 is the largest depth from concave surfaces of the fiber to the largest height of convex surfaces of the fiber, and d is the diameter of the fiber, as defined in U.S. Pat. No. 4,455,347). Cotton-like acrylic fiber of the present invention possesses a surface roughness of less than 0.05 preferably less than 0.025, and more preferably less than 0.01.

Figure 2:
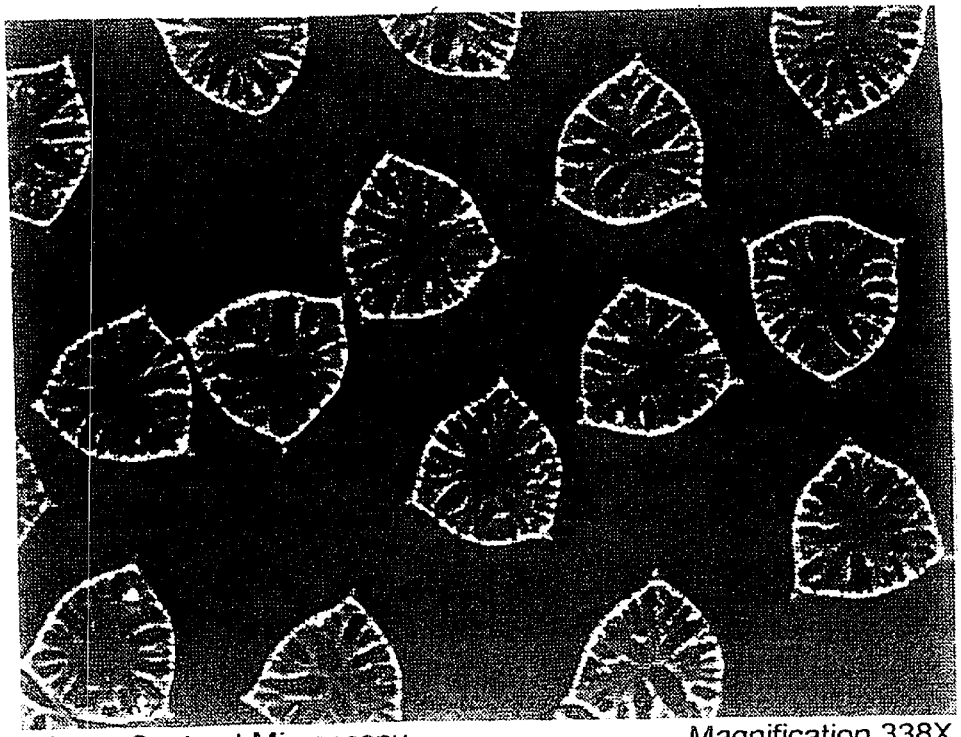
FIG. 2 is an enlarged microscopic photograph (phase contrast microscopy; magnification: 1070 times) of the cross-section of a fiber of the present invention in which the fiber possesses a denier of less than 1.5 dpf.

In another embodiment of the present invention, cotton-like acrylic fiber is produced that comprises less than two internal voids within a cross-section of the fiber, as shown in FIG. 2. The void(s) may be a micron or more and extend parallel to the fiber. Preferably, the void is greater than 0.5 microns, and more preferably more than 0.1 microns. The fiber possesses a denier of less than 5.0 dpf, preferably less than 3.0 dpf, and more preferably less than 1.0 dpf. The surface roughness of the fiber may be greater than 0.05 and more preferably less than 0.05.

In a process for preparing cotton-like acrylic fiber, an acrylic fiber polymer precursor may be produced by using continuous free radical redox aqueous dispersion polymerization, in which water is the continuous phase and the initiator is water soluble. The redox system consists of a persulfate (the oxidizing agent and initiator, sometimes called "catalyst"), sulfur dioxide or a bisulfite (reducing agent, sometimes called "activator") and iron (the true redox catalyst). This redox system works at pH 2 to 3.5 where the bisulfite ion predominates and where both the ferric and ferrous ion are sufficiently soluble. The kinetic equations are represented as follows:

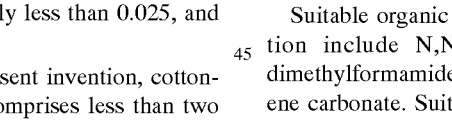

$$S_2O_8^{2-}+Fe^{2+} \rightleftharpoons SO_4^{2-}+SO_4^{*1-}+Fe^{3+}$$

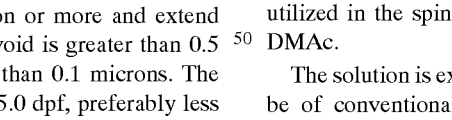

$$HSO_3^{1-}+Fe^{3+} \rightleftharpoons HSO_3^{*}+Fe^{2+}$$

The * represents the free radical formed in the sulfate and sulfonate redox reaction system.

Salts of the initiator and activator may be used such as ammonium, sodium, or potassium. Additionally, a persulfate initiator or an azo initiator may be utilized to generate free radicals for the vinyl polymerization rather than the above-mentioned redox system. Other methods for preparing the polymer precursor may be utilized, such as solution or emulsion polymerization.

In an embodiment of the present invention, the acrylic fiber polymer precursors thus obtained may be used to form acrylic fibers by various methods, including dry and wet spinning such as those set forth in U.S. Pat. Nos. 3,088,188; 3,193,603; 3,253,880; 3,402,235; 3,426,104; 3,507,823; 3,867,499; 3,932,577; 4,067,948; 4,294,884; 4,447,384; 4,873,142; and 5,496,510, the entire subject mater of which is incorporated herein by reference. Preferably, the fibers of the present invention are formed by wet spinning.

For example, acrylic fiber polymer precursors of the present invention may be dissolved in an organic solvent or mixtures of organic solvents, which may contain 0 to 3 wt. % water. The solution may contain 10 to 40 wt. % polymer, preferably, 15 to 35 wt. %, and more preferably 18 to 28 wt. % of the solution. In inorganic solvents, the solution may contain 8 to 15 wt. % polymer and preferably greater than 8 wt. %. The solution may be heated to a temperature of 50–150° C., preferably 70–140° C., and more preferably 80–120° C. to dissolve the polymer.

The solvent in the spin bath is normally the same solvent in which the polymer is dissolved prior to spinning. Water may also be included in the spin bath and generally that portion of the spin bath will comprise the remainder.

Suitable organic spinning solvents for the present invention include N,N-dimethylacetamide (DMAc), N,N-dimethylformamide (DMF), dimethylsulfoxide, and ethylene carbonate. Suitable inorganic solvents include aqueous sodium thiocyanate and nitric acid. Preferably, the solvent utilized in the spinning process of the present invention is DMAc.

The solution is extruded through a spinnerette (which may be of conventional design) into a coagulating bath. For DMAc solvent wet spinning the coagulating or spin bath is maintained at a temperature of from 10–80° C., preferably 20–70° C., and more preferably 30–60° C. Generally, the spin bath contains 10 to 70 wt. %, preferably 15 to 65 wt. %, and more preferably 20 to 60 wt. % of solvent by weight of the spin bath. As referred to herein, the terms fiber and filament are utilized interchangeably.

The spun filaments may be subjected to jet stretch. Jet stretch, which is the speed of the first stretching roll set contacted by the filaments on exiting the spinneret divided by the velocity of the polymer solution through the spinneret, is controlled between 0.2 and 1.2, preferably 0.4 to 1.0. Please amend Table 1 on page 13 to read as follows:

TABLE I

ACRYLIC FIBER LUSTER MEASUREMENTS

| PROCESS CONDITION | COMPARATIVE EXAMPLE 1 | COMPARATIVE EXAMPLE 2 | COMPARATIVE EXAMPLE 3 | EXAMPLE 4 | EXAMPLE 5 |
|---|---|---|---|---|---|
| Polymer Type % AN/% VA | 92.6/7.4 | 92.6/7.4 | 92.6/7.4 | 92.6/7.4 | 92.6/7.4 |
| Dope Solids, % | 24.8 | 24.8 | 20.6 | 20.6 | 20.6 |
| Spinneret Capillary Type/Size, inches | Round 0.002 in. | Round 0.002 in. | Triangle 0.005 in./side | Round 0.002 in. | Triangle 0.0028 in./side |
| Capillary Stretch Ratio | 0.64 | 0.96 | 0.71 | 0.73 | 0.41 |
| Wet Spin Bath % DMAc Solvent/Temp | 51%/38 C. | 51%/49 C. | 30%/50 C. | 30%/50 C. | 30%/50 C. |
| Wet Stretch Ratio | 5.7 | 6.0 | 4.0 | 5.0 | 5.0 |
| Plastic Stretch Ratio | None | None | 1.81 | 1.3 | 1.3 |
| Denier, dpf | 1.5 | 0.95 | 1.2 | 0.95 | 0.95 |
| Roughness, l/d | <0.05 | 0.02–0.14 | 0.04–0.28 | <0.025 | <0.025 |
| Void Size, microns | <0.01 | <0.01 | >2 | 0.56 | 0.5 |
| Gloss (BGL $R_S$) | 16.0 | 16.6 | 14.6 | 24.6 | 29.4 |
| Reflectance (BGL $R_D$) | 45.6 | 44.7 | 49.8 | 30.9 | 26.3 |
| Luster (BGL) | 87.1 | 87.8 | 84.6 | 94.4 | 96.0 |

Subsequently, the filaments may be subjected to wet stretch. Wet stretch between 2× ad 8× is provided by feeding the filaments into a second higher speed roll set and stretching the wet filaments. Wet stretch of from 3 to 6× is preferred. The temperature employed in the wet stretch process may range between the glass transition temperature but less than the melting temperature of the polymer.

The fibers produced by the above described process may be treated by "in-line relaxation" or batch annealing prior to final use. In-line relaxation is achieved by feeding the filaments into a hot water bath, usually 80° C. to boiling and withdrawing the filaments at a slower speed to compensate for shrinkage, which takes place in the bath. The relaxed filaments are dried by conventional heated rolls or heated air and are suited for use as is or after being converted to staple. Alternately, heated rolls may be utilized to dry the fibers and to stretch the filaments via "plastic stretching" (stretching the filaments and applying heat to render the filaments pliable) even further up to 3×, preferably up to 2×, and more preferably up to 1.5×. These fibers can be batch, steam annealed to adjust fiber properties.

In an embodiment of the present invention, the acrylic fiber polymer precursor comprises acrylonitrile in an amount from 60 to 98.0 wt. %; and vinyl monomer in an amount from 2 to 40 wt. %.

In an embodiment of the present invention, the acrylic fiber comprises an acrylic fiber having acrylonitrile in an amount from 85 to 98.0 wt. % and vinyl monomer in an amount from 2 to 15 wt. %.

The polymeric materials of the acrylic fibers may be polyacrylonitrile copolymers, including binary and ternary polymers containing at least 50 wt. % of acrylonitrile in the polymer molecule; or a blend comprising polyacrylonitrile or copolymers comprising acrylonitrile with from 2 to 50 wt. % of another polymeric material, a blend having an overall polymerized acrylonitrile content of at least 50 wt. %.

In an embodiment of the present invention, vinyl comonomer, such as vinyl acetate, vinyl chloroacetate, vinyl proprionate, vinyl stearate, methyl acrylate, methyl methacrylate, etc., is also included in the polymeric materials in an amount greater than 0 to 50 wt. % of the polymeric material. Preferably, the neutral vinyl monomer is present in an amount from about 1 to about 20 wt. %, and more preferably from about 2.0 to about 10 wt. % of the polymeric material. The vinyl monomer is preferably vinyl acetate.

Other monomers may be included in the acrylic fiber polymer precursor formulation. For example, such monomers include suitable monoolefinic monomers, including acrylic, alpha-chloro-acrylic and meta-acrylic acid; the acrylates, such as methylacrylate, methylmethacrylate, ethylmethacrylate, butylmethacrylate, methoxy methylmethacrylate, beta-chloroethylmethacrylate, and the corresponding esters of acrylic and alpha-chloro-acrylic acids; vinyl chloride, vinyl fluoride, vinyl bromide, vinylidene chloride, 1-chlor-1-bromo-ethylene; methacrylonitrile; acrylamide and methacrylamide; alpha-chloroacrylamide; or monoalkyl substitution products thereof; methylvinyl ketone, N-vinylimides, such as N-vinylphthalimide and N-vinylsuccinimide; methylene malonic esters; and itaconic esters, N-vinylcarbazole, vinyl furane; alkyl vinyl esters; styrene, vinyl naphthalene, vinyl-substituted tertiary heterocyclic amines, such as the vinylpyridines and alkyl-substituted vinylpyridine, for example 2-vinylpyridine, 4-vinylpyridine, 2-methyl-5-vinylpyridine, etc.; 1-vinyl-imidazole and alkyl-substituted 1-vinylimidazoles such as 2-, 4-, and 5 methyl-1-vinylimidazole, and other vinyl containing polymerizable materials.

The acrylic fiber polymer precursor may be a ternary or higher interpolymer. For example, products obtained by the interpolymerization of acrylonitrile and two or more of any of the monomers, other than acrylonitrile, enumerated above may be utilized.

Other vinyl monomers of the present invention include itaconic acid, acrylic acid, methacrylic acid, vinyl sulfonic acid, sodium methallyl sulfonate, sodium styrene sulfonate, sodium p-sulfophenyl methallyl ether, sodium p-ethallyloxybenzensulfonate, sodium p-propallyloxybenzenesulfonate, acrylamido tertiary butyl sulfonic acid, sodium 2-methyl-2-acrylamido propane sulfonate, potassium p-ethallyloxybenzenesulfonate, lithium p-ethallyloxybenzenesulfonate, sodium p-methallyloxybenzenesulfonate, sodium 2-ethyl-4-ethallyloxybenzenesulfonate, sodium 2-propyl-4-methallyloxybenzenesulfonate, sodium-3-methyl-4-methallyloxybenzenesulfonate, potassium p-methallyloxybenzenesulfonate, potassium p-propallyloxybenzenesulfonate, potassium 2-ethyl-4-methallyloxybenzenesulfonate, ammonium p-methalyloxybenzenesulfonate, barium p-methallyloxybenzenesulfonate, magnesium p-methallyloxybenzenesulfonate, calcium p-methallyloxybenzenesulfonate, lithium m-methallyloxybenzenesulfonate, magnesium m-methallyloxybenzenesulfonate, calcium m-methallyloxybenzenesulfonate, barium m-methallyloxybenzenesulfonate, sodium o-methallyloxybenzenesulfonate, potassium o-methallyloxybenzenesulfonate, magnesium o-methallyloxybenzenesulfonate, ammonium o-methallyloxybenzenesulfonate, sodium 2-methyl-4-methalyloxybenzenesulfonate, sodium 2-methyl-3-methallyloxybenzenesulfonate, sodium 4-methyl-3-methallyloxybenzenesulfonate, sodium 5-methyl-3-methallyloxybenzenesulfonate, sodium 2-methyl-5-methallyloxybenzenesulfonate, sodium 5-methyl-2-methallyloxybenzenesulfonate, sodium 5-methyl-2-methallyloxybenzenesulfonate, sodium 6-methyl-2-methallyloxybenzenesulfonate and the like. Preferably, the ionic vinyl monomer of the present invention is sodium p-sulfophenyl methallyl ether.

Preferably, the acrylic fiber polymer precursor comprises 90.0 to 98.0 wt. % acrylonitrile and from about 2 to 10 wt. % vinyl acetate.

EXAMPLES

In the fiber spinning and structure comparisons, acrylonitrile based polymer containing 7.4% vinyl acetate comonomer is dissolved in dimethylacetamide solvent at 80° C. for 1 hour. The clear dope without delustrants is metered from a supply tank, through a heated transfer line and filter, to a spinneret which is submerged in a DMAc/Water bath. The coagulated filaments are pulled from the temperature and concentration controlled spin bath using driven rolls with speed control. This roll speed, dope extrusion rate and spinneret area determine the jet stretch ratio, roll speed (ft/min) divided by the dope rate (ft/min). The excess solvent is washed from the fiber and the fiber is drawn in hot water using a second roll set with speed control. The difference in the first and second roll set speed is the wet stretch ratio. A textile finish is applied and the fiber is dried on a heated, metal roll surface. The fiber is collected and batch steam annealed to the desired denier.

EXAMPLES 1–3 represent comparative fibers, while EXAMPLES 4 and 5 represent fibers according to the present invention (Table 1).

Example 1

The fiber of this Example 1 is spun through a round capillary with diameter of 0.002 inches and yields a fiber having no voids (<0.01 micron) present therein a 1.5 dpf fiber. The fiber possesses a surface roughness (l/d) less than 0.05. The Gloss and Luster values are less than desired with the Reflectance values higher than desired for the Cotton-Like fiber.

Example 2

The fiber in Example 2 is spun in a similar manner as Example 1 with the exception of higher stretch ratios to achieve a 0.95 dpf fiber. Again there are no voids present, but the surface roughness (l/d) has increased to values as high as 0.14. The Gloss and Luster values remain lower than desired and the Reflectance value is higher than desired for a Cotton-Like fiber.

Example 3

The fiber in Example 3 is prepared with spinning conditions to increase surface roughness and the void content for a low denier fiber. Departing from Examples 1 and 2, the polymer solids are lowered to 20.6%, a triangular shaped capillary (equilateral with 0.005 inches per side) is used, and the spin bath and stretch conditions are altered according to Table 1. The 1.2 dpf fiber has increased surface roughness (0.04 to 0.28) and multiple voids of 2 micron size. The fiber Gloss and Luster remain lower than desired as in Examples 1 and 2. The fiber has a dry handle even for at 1.2 dpf and lower deniers.

Example 4

The fiber in EXAMPLE 4 is spun similar to Example 3 with the exception of using a round capillary of 0.002 inch diameter. The stretch ratios are changed to achieve a 0.95 dpf fiber. The fiber is characterized by a smooth surface (l/d<0.025) with a single void located in the middle of the fiber having a diameter of 0.56 microns. The Gloss and Luster values are high with low Reflectance compared to the previous examples. The fiber has the handle and luster of fine Cotton.

Example 5

The fiber in EXAMPLE 5 is spun similar to Example 4 with the exception of using a triangular capillary with equal sides of length 0.0028 inches. Again the final fiber denier is 0.95 dpf. The fiber of Example 5 has a smooth surface (l/d<0.05) and contains a single void within the fiber with a diameter of 0.5 microns. The fiber of Example 5 has high Gloss and Luster with low Reflectance. The fiber has very good handle and luster like fine cotton.

TABLE I demonstrates the optical and physical properties of the fibers set forth comparative EXAMPLES 1–3 with the optical and physical properties of the fibers set forth in EXAMPLES 4 and 5 according to the present invention. The properties of the fibers of the present invention (EXAMPLES 4 and 5) provide acrylic fiber having superior cotton-like qualities than those of the fibers set forth in EXAMPLES 1–3.

TABLE I

ACRYLIC FIBER
LUSTER MEASUREMENTS

| PROCESS CONDITION | COMPARATIVE EXAMPLE 1 | COMPARATIVE EXAMPLE 2 | COMPARATIVE EXAMPLE 3 | EXAMPLE 4 | EXAMPLE 5 |
|---|---|---|---|---|---|
| Polymer Type % AN/% VA | 92.6/7.4 | 92.6/7.4 | 92.6/7.4 | 92.6/7.4 | 92.6/7.4 |
| Dope Solids, % | 24.8 | 24.8 | 20.6 | 20.6 | 20.6 |
| Spinneret Capillary Type/Size, inches | Round 0.002 in. | Round 0.002 in. | Triangle 0.005 in./side | Round 0.002 in. | Triangle 0.0028 in./side |
| Capillary Stretch Ratio | 0.64 | 0.96 | 0.71 | 0.73 | 0.41 |

TABLE I-continued

ACRYLIC FIBER LUSTER MEASUREMENTS

| PROCESS CONDITION | COMPARATIVE EXAMPLE 1 | COMPARATIVE EXAMPLE 2 | COMPARATIVE EXAMPLE 3 | EXAMPLE 4 | EXAMPLE 5 |
|---|---|---|---|---|---|
| Wet Spin Bath % DMAc Solvent/Temp | 51%/38 C. | 51%/49 C. | 30%/50 C. | 30%/50 C. | 30%/50 C. |
| Wet Stretch Ratio | 5.7 | 6.0 | 4.0 | 5.0 | 5.0 |
| Plastic Stretch Ratio | None | None | 1.81 | 1.3 | 1.3 |
| Denier, dpf | 1.5 | 0.95 | 1.2 | 0.95 | 0.95 |
| Roughness, l/d | <0.05 | 0.02–0.14 | 0.04–0.28 | <0.025 | <0.025 |
| Void Size, microns | <0.01 | <0.01 | >2 | 0.56 | 0.5 |
| Gloss | 16.0 | 16.6 | 14.6 | 24.6 | 29.4 |
| Reflectance | 45.6 | 44.7 | 49.8 | 30.9 | 26.3 |
| Luster | 87.1 | 87.8 | 84.6 | 94.4 | 96.0 |

What is claimed is:

1. An acrylic fiber having cotton-like properties, said acrylic fiber comprising a BYK Gardner Lustermeter (BGL $R_D$) reflectance measurement of less than about 44.

2. An acrylic fiber according to claim 1, wherein said reflectance measurement is less than about 35.

3. An acrylic fiber according to claim 1, wherein said acrylic fiber comprises a BYK Gardner Luster (BYL) gloss measurement of greater than about 17.

4. An acrylic fiber according to claim 1, wherein said acrylic fiber comprises a BYK Gardner Lustermeter (BGL $R_S$) gloss measurement of greater than about 17.

5. An acrylic fiber according to claim 1, wherein said acrylic fiber comprises a BYK Gardner Lustermeter (BGL $R_S$) gloss measurement of greater than about 20.

6. An acrylic fiber according to claim 1, wherein said acrylic fiber comprises a BYK Gardner Lustermeter (BGL $R_S$) gloss measurement of greater than about 22.

7. An acrylic fiber according to claim 1, wherein said acrylic fiber comprises a BYK Gardner Lustermeter (BGL) luster measurement of greater than about 88.

8. An acrylic fiber according to claim 1, wherein said acrylic fiber comprises a BYK Gardner Lustermeter (BGL) luster measurement of greater than about 90.

9. An acrylic fiber according to claim 1, wherein said acrylic fiber comprises a BYK Gardner Lustermeter (BGL) luster measurement of greater than about 92.

10. An acrylic fiber having cotton-like properties comprising one internal void voids within a cross-section of said fiber, said void extending parallel to said fiber; and wherein said fiber has a denier of less than 1.5 and a BYK Gardner Lustermeter (BGL $R_D$) reflectance measurement of less than about 44.

11. An acrylic fiber according to claim 10, wherein said denier is less than 0.7 dpf.

12. An acrylic fiber according to claim 10, wherein said denier is less than 0.7 dpf.

13. An acrylic fiber according to claim 10, wherein said acrylic fiber comprises one internal void.

14. An acrylic fiber according to claim 10, wherein said acrylic fiber comprises a surface roughness greater than 0.05.

15. An acrylic fiber having cotton-like properties comprising one internal void within a cross-section of said fiber, said void extending parallel to said fiber said fiber having a surface roughness of l/d<0.025.

16. An acrylic fiber according to claim 15, wherein said acrylic fiber comprises a denier of less than 5.0 dpf.

17. An acrylic fiber according to claim 15, wherein said acrylic fiber comprises a denier of less than 3.0 dpf.

18. An acrylic fiber according to claim 15, wherein said acrylic fiber comprises a denier of less than 1.0 dpf.

19. An acrylic fiber according to claim 15, wherein said acrylic fiber comprises a microdenier of less than 0.5 dpf.

* * * * *

UNITED STATES PATENT AND TRADEMARK OFFICE

CERTIFICATE OF CORRECTION

PATENT NO. : 6,740,722 B2 
DATED : May 25, 2004
INVENTOR(S) : Gary J. Capone, Danny W. Carter and C. Wayne Emerson It is certified that error appears in the above-identified patent and that said Letters Patent is hereby corrected as shown below:

Column 9,
Line 46, delete "void voids" and insert -- void --

Signed and Sealed this

Twenty-eighth Day of September, 2004

JON W. DUDAS
*Director of the United States Patent and Trademark Office*